United States Patent [19]

Buckle

[11] 4,101,998

[45] * Jul. 25, 1978

[54] BUOYANCY CONTROL APPARATUS FOR DIVERS

[76] Inventor: Brian Leonard Buckle, 16 Sunningdale Grove, Colwyn Heights, Colwyn Bay, Wales

[ * ] Notice: The portion of the term of this patent subsequent to Mar. 1, 1994, has been disclaimed.

[21] Appl. No.: 787,060

[22] Filed: Apr. 13, 1977

[30] Foreign Application Priority Data

Apr. 14, 1976 [GB] United Kingdom ..... 15284/76
Sep. 3, 1976 [GB] United Kingdom ..... 36604/76

[51] Int. Cl.[2] ..... B63C 9/16

[52] U.S. Cl. ..... 9/316; 61/70; 114/16 E; 128/142 R

[58] Field of Search ..... 9/313, 314, 316, 319, 9/322, 342, 339, 336; 114/16 E, 16.4; 61/69 R, 70; 128/140 R, 142 R, 142 G, 142.2, 142.4

[56] References Cited

U.S. PATENT DOCUMENTS

| | | | |
|---|---|---|---|
| 3,161,028 | 12/1964 | Odum et al. | 114/16 E |
| 3,338,238 | 8/1967 | Warncke | 128/142.2 |
| 3,495,413 | 2/1970 | Pinto | 114/16 E |
| 4,009,583 | 3/1977 | Buckle | 114/16 E |

*Primary Examiner*—Trygve M. Blix
*Assistant Examiner*—Jesus D. Sotelo
*Attorney, Agent, or Firm*—Oblon, Fisher, Spivak, McClelland & Maier

[57] ABSTRACT

A buoyancy control system for carrying by a diver has a fluid-tight reservoir comprised of a plurality of parallel longitudinally extending passageways, into which water and compressed gas can be selectively admitted through respective inlet valves to displace gas and water respectively in the reservoir through respective outlet valves. The relative amounts of water and gas in the reservoir can therefore be adjusted to provide a required degree of buoyancy for the diver.

11 Claims, 3 Drawing Figures

BUOYANCY CONTROL APPARATUS FOR DIVERS

BACKGROUND OF THE INVENTION

1. Field of the Invention

The present invention relates to the control of buoyancy of a diver and provides a buoyancy control apparatus whereby buoyancy of the diver can be varied in accordance with the desired operating depth of the diver and/or the rate at which the diver desires to change depth.

A buoyancy control apparatus is known which is adapted to be carried by a diver and comprising a fluid-tight reservoir constituted by tubing having fluid inlet and outlet ends; a valved water inlet member for admitting water to the reservoir from externally of the apparatus; a valved water outlet member for releasing water from the reservoir to externally of the apparatus; a valved gas inlet member for admitting compressed gas to the reservoir; and a valved gas outlet member for releasing gas from the reservoir, the arrangement being such that water or gas can be admitted to the reservoir to displace gas or water respectively already in the reservoir thereby to change the buoyancy of the apparatus. It is also known that the tubing of such apparatus usually will be coiled or looped in a serpentine configuration.

SUMMARY OF THE INVENTION

I have now found that the performance of the aforementioned buoyancy control apparatus can be significantly improved by dividing the aforementioned tubing into a plurality of parallel longitudinally extending fluid passageways. Moreover, I have also found that the provision of said passageways permits the replacement of the previously referred serpentine tubing by two or more spaced parallel tubes each comprised of a said plurality of passageways.

According to the present invention therefore, there is provided a buoyancy control apparatus adapted to be carried by a diver and comprising a fluid-tight reservoir; a valved water inlet member for admitting water to the reservoir from externally of the apparatus; a valved water outlet member for releasing water from the reservoir to externally of the apparatus; a valved gas inlet member for admitting compressed gas to the reservoir; and a valved gas outlet member for releasing gas from the reservoir, wherein the reservoir comprises a plurality of parallel longitudinally extending fluid passageways and the arrangement being such that water or gas can be admitted to the passageways to displace gas or water respectively already in the reservoir thereby to change the buoyancy of the apparatus.

Preferably, the reservoir comprises two or more, especially eight, parallel tubes each comprised of a said plurality of passageways. It is especially preferred that the said tubes are straight and that the passageways are twisted en masse (i.e. as a bundle) through, for example, 180° about the longitudinal axis of the respective tube. Suitably, the tubes can be arranged in pairs, each pair having at respective ends common manifolds.

Conveniently, the tubes can be 18 to 30 inches, especially about 24 inches, long and from 2 to 4 inches, especially about 3 inches, internal diameter. Usually, they will be made of aluminium or other light non-rusting metal or alloy.

The passageways usually will be constituted by one or more bundles of narrow (with respect to the reservoir) bore tubes, especially thin-walled plastics tubes, inserted into the reservoir. Usually, the passageways will be of 0.1 to 0.4 inches, especially about 0.15 inches, internal diameter.

It is preferred that the apparatus be a self-contained unit including a source of compressed gas, usually air. When the compressed gas is of the same type as that used as a life-support for the diver, the gas for breathing and for buoyancy control may be supplied from the same compressed gas reservoir. However, separate compressed gas reservoirs can be used for breathing and normal buoyancy control. In order to provide additional compressed gas for emergency purposes, especially when rapid ascent (i.e. rapid increase in buoyancy) is required, a second valved gas inlet member may be provided to admit to the fluid reservoir compressed gas at a higher pressure than that normally admitted. The higher pressure gas may be supplied from the life-support reservoir or from an auxiliary compressed gas reservoir which can itself be recharged from the life-support reservoir. The gas normally supplied preferably is of the order of hundreds of pounds pressure per square inch, typically 110 psi, whereas that supplied for emergency purposes preferably is of the order of thousands of pounds pressure per square inch, typically 3,000 psi. The latter pressure is conveniently that at which compressed gas is usually supplied in cylinders for diving purposes. Such a cylinder may be used to provide gas to the first valved gas inlet member via a pressure reducer.

Usually the valved water inlet and outlet members and the valved gas outlet member will connect the reservoir with the ambient environment of the apparatus.

Suitably, the valved gas inlet member and valved gas outlet member are provided at one end of the or each length of passageways and the valved water inlet member and valved water outlet member are provided at the other end of the or each respective length of passageways. In this case, the water inlet and outlet members can be constituted by the same member.

The valved water inlet member and valved water outlet member preferably are controlled by a common mechanism, such as by a common control valve controlling a compressed air supply to diaphragm valves of the respective members and normally biassed to their closed positions.

The valved gas inlet member and, when present the second valved gas inlet member may each be a manually actuated valve, for example a press-button operated valve of the kind commonly used in compressed gas systems.

As mentioned above, the apparatus preferably is a self-contained unit. It is preferred that such a unit be adapted to be carried as a back-pack by the diver. To this end, the apparatus preferably comprises a housing for location on a diver's back to accommodate at least the bulk of the apparatus and member for carrying the housing in that position. Said member suitably comprises a pair of arms adapted to extend from the housing over the diver's shoulders. These arms advantageously are joined at their free ends in a control unit incorporating manually operable controls for the valves. These arms can be hollow to carry from the housing compressed gas supply pipes.

The following is a description by way of example only and with reference to the accompanying drawings of a presently preferred embodiment of the invention. In the drawings.

Figure 1:
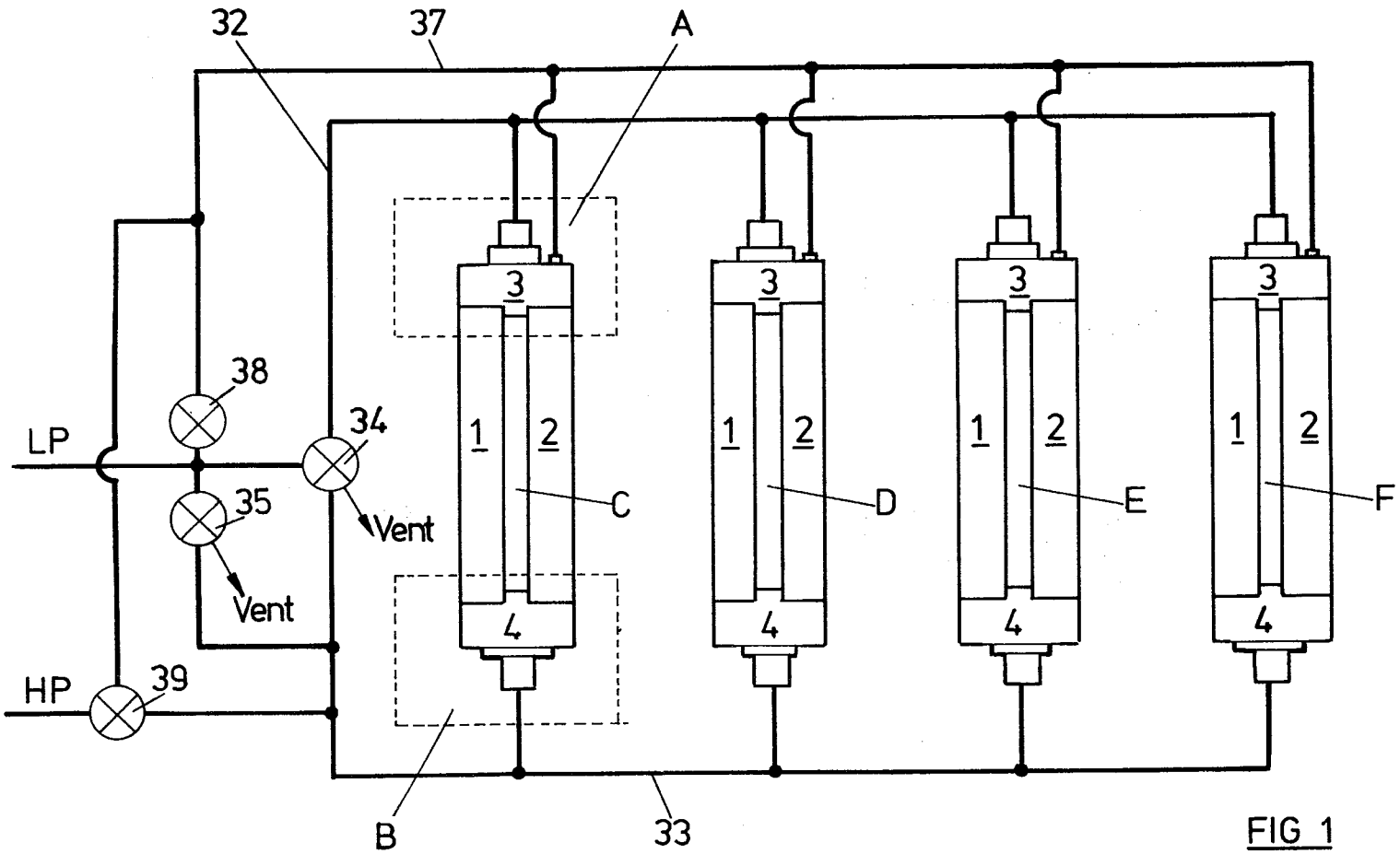
FIG. 1 is a schematic representation of a buoyancy control apparatus.

Referring to the drawings, a buoyancy control apparatus according to a preferred embodiment of the present invention comprises four pairs of identical buoyancy tubes C, D, E and F disposed in a spaced parallel array. Each pair of tubes comprises a first tube 1 and a spaced parallel tube 2. Said tubes 1, 2 are of right cylindrical shape of about 24 inches length and 3 inches internal diameter. They are closed at their respective ends in a common head manifold 3 and a common bottom manifold 4. The tubes 1, 2 are packed with a plurality of parallel longitudinally extending thin-walled plastics tubes 5 of about 0.15 inch bore arranged in a bundle having a 180° twist about the longitudinal axis of the respective tubes 1, 2.

Figure 2:
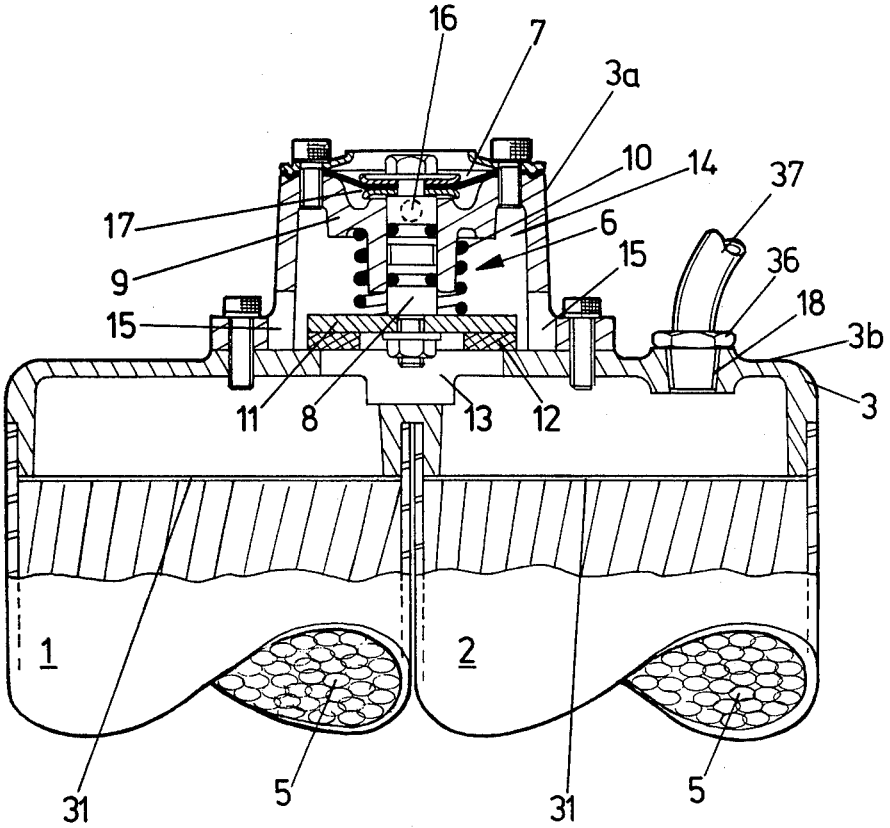
FIG. 2 is an enlarged cross-sectional view of the area A of FIG. 1.

The head manifold 3 has an upstanding cylindrical extension 3*a* bolted thereto and accommodates a control valve 6 of the diaphragm type. This valve 6 has a resiliently flexible diaphragm 7 clamped at its peripheral edge and secured at its centre to a stem 8 axially slidable in a guide 9. The stem 8 is biassed axially inwardly with respect to the manifold 3 by a spring 10 acting against a disc 11 at the axially inner end of the stem. This disc 11 carries an annular seat 12 controlling the flow of fluid through a central orifice 13 communicating the manifold 3 with a chamber 14 surrounding the guide 9. Three outlets 15 (of which only two are visible in the view of FIG. 2) extend radially through the manifold extension 3*a* at angularly spaced locations to communicate with chamber 14. A bore 16 having an internally threaded entrance also extends radially through extension 3*a* to communicate with an axially inner chamber 17 bounded by diaphragm 7. The axially outer side of the diaphragm 7 is directly exposed to ambient fluid pressure. A second bore 18 which is internally threaded extends axially through the radially extending wall 3*b* of manifold 3 to communicate with said manifold.

It will be appreciated that when the force exerted on the diaphragm 7 by the fluid pressure in chamber 17 exceeds the combined forces exerted on the diaphragm 7 by spring 10 and the ambient fluid pressure, the seat 12 will be moved axially outwardly by stem 8 moving in response to movement of diaphragm 7 and thereby opening the orifice 13 for fluid flow therethrough. Similarly, seat 12 will be moved axially outwardly to open orifice 13 when the force exerted on disc 11 by fluid pressure in the manifold 3 exceeds the combined force exerted by said spring 10 and ambient fluid pressure.

Figure 3:
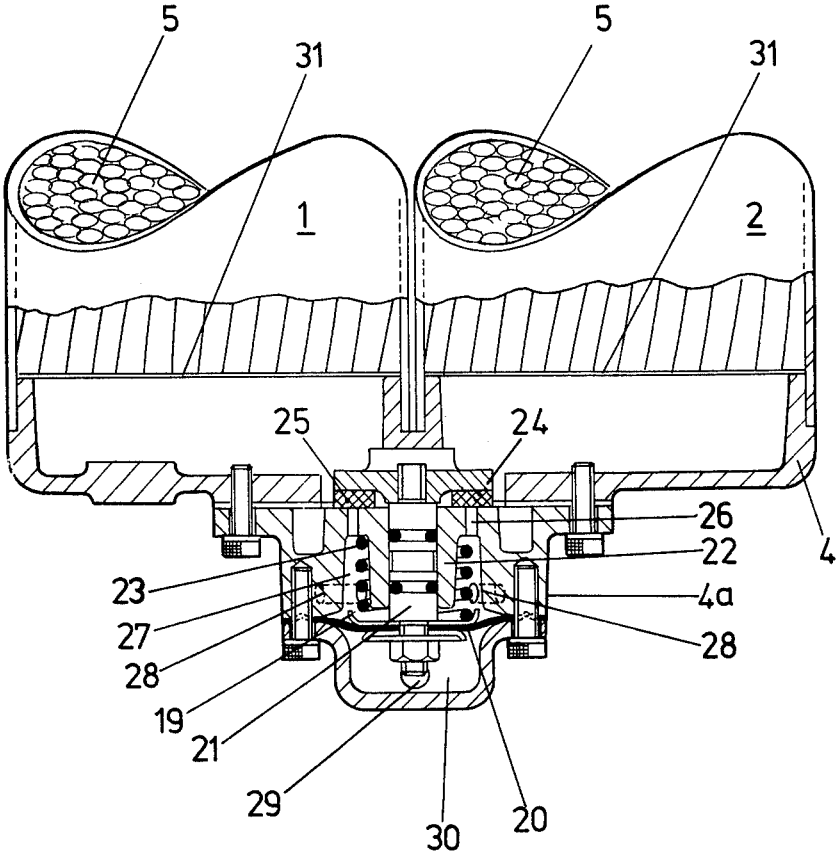
FIG. 3 is an enlarged cross-sectional view of the area B of FIG. 1.

The bottom manifold 4 has a depending cylindrical cap 4*a* bolted thereto and accommodates a control valve 19 of the diaphragm type. This valve 19 has a resiliently flexible diaphragm 20 clamped at its peripheral edge and secured at its centre to a stem 21 axially slidable in a guide 22. The stem 21 is biassed axially inwardly (with respect to manifold 4) by a spring 23 and has at its axially inner end a disc 24 carrying an annular seat 25. This seat 25 controls the flow of fluid through five angularly spaced outlets 26 (of which only two are visible in FIG. 3) communicating manifold 4 with an annular chamber 27 in cap 4*a*. In its axially outward position, the seat 25 closes said outlets 26. Seven angularly spaced bores 28 (of which only two are visible in FIG. 3) extend radially through cap 4*a* to communicate chamber 27 with ambient fluid. A bior 29 having a tapered internally threaded entrance extends radially through cap 4*a* to communicate with an axially outer chamber 30 bounded by diaphragm 20.

It will be appreciated that when the force exerted by the fluid pressure in chamber 30 upon the diaphragm 20 exceeds the opposing combined force exerted by the spring 23 and fluid pressure in manifold 4, the seat 25 will be moved axially inwardly by stem 21 in response to movement of the diaphragm 20 and thereby outlets 26 will be opened.

The tubes 5 are held in position at the respective ends of tubes 1, 2 by foraminous plates 31 which are non-rotatably fixed in the tubes.

Bores 16 and 29 threadably receive couplings of lines 32 and 33 respectively supplied via control valve 34 from a low pressure (about 110psi) compressed air source LP. The valve 34 is normally vented to ambient fluid to exhaust overpressure in lines 32, 33 but on operation to connect the air source LP with lines 32, 33 said vent is closed. Valve 34 is of the press-button control type but could be, for example, a screw valve.

Line 33 is also connected to air source LP via a second control valve 35 which permits air supply to line 33 independently of air supply to line 32. Valve 35 is a press-button valve venting to ambient fluid in the same manner as valve 34. The rate at which either of valves 34, 35 vent line 33 is, of course, lower than the rate at which air can be supplied to said line in order that valve 19 can be operated from the air supply LP.

Bore 18 threadably receives a coupling 36 of line 37 connected via control valve 38 to the low pressure air supply LP. Valve 38 is also of the push-button control type but does not have the venting facility of valves 34 and 35. Valves 35 and 38 are arranged adjacent each other so that they can be simultaneously operated by fingers of the same hand of the diver carrying the apparatus.

Lines 33 and 37 are also connected via a control valve 39 to a source of high pressure (about 3000 psi) compressed air HP. Said valve 39 is of the same type as valve 38.

The apparatus described above is housed in a conventional pack adapted to be carried on a diver's back. The air supplies LP and HP are provided by compressed air cylinder(s) carried by the pack with the high pressure supply HP taken directly from the cylinder and the low pressure supply LP taken from the cylinder via a pressure reducer used to supply air to a face mask. The control valves, 34, 35, 38 and 39 are located in positions where they can readily be operated by a diver wearing the pack.

When a diver wearing the pack wishes to decrease his buoyancy he depresses valve 34 thereby permitting air from supply LP to pass through lines 32 and 33 to open valves 6 and 19 respectively and permit fluid flow through orifice 13, outlets 15 and 26 and bores 28. In the usual attitude of the diver, manifold 3 will be above manifold 4 and hence water will enter manifold 4 to displace air through manifold 3. The water passes through bores 28 into chamber 27, through outlets 26 into manifold 4 and thence into the bottom of tubes 5. Air is displaced from the top of the tubes 5 by the inflowing water and passes via manifold 3 into chamber 14 and thence through outlets 15. The valves 6 and 19 are retained in their open condition by continued depression of valve 34 until the desired reduction in buoyancy has been obtained. Valve 34 is then released allowing lines 32 and 33 to vent causing valves 6 and 19 to close under their spring bias. In the event that manifold 4 is above manifold 3, the water and air flows will be reversed to those described above.

When it is desired to increase his buoyancy, the diver depresses valves 35 and 38 simultaneously thus opening valve 19 and supplying low pressure air via line 37 to manifold 3. Air from manifold 3 enters tubes 5 to displace water from the tubes into manifold 4 and thence via outlets 26, chamber 27 and bores 28 from the apparatus. When the desired buoyancy increase has been obtained, valves 35 and 38 are released thereby stopping the air supply to manifold 3 and allowing valve 19 to close by venting line 33. A fine degree of control of buoyancy increase can be achieved by depressing valve 38 alone and allowing air into manifold 3 without opening valve 19. The air pressure within the manifold can then increase until it exceeds the pressure required to open valve 6, which valve thereby acts as a safety valve protecting the apparatus against excessive pressure. When sufficient air has been introduced into manifold 3, small changes in buoyancy can be obtained by depressing only valve 35 to allow water to be expelled under the overpressure of air in the manifold 3. In the event that manifold 4 is above manifold 3, the water and air flows through valves 6 and 19 will be reversed to those described above.

In the event of an emergency, very rapid increase in buoyancy can be obtained by depressing valve 39 to supply high pressure air to lines 33 and 37.

It will be appreciated that the invention is not restricted to the details described above with reference to the drawings and that numerous modifications and variations can be made without departing from the scope of the invention as defined in the following claims.

Without wishing to restrict the invention to a particular theory of operation, it is believed that the division of fluid in the reservoir into a plurality of passageways has two distinct advantages. Firstly, it is easier to displace a given volume of fluid if it is divided into such passageways because the direction of displacement is limited by the walls of the passageways. Secondly, the rate at which a given volume of gas rises in a liquid decreases with increased division of said volume. Thus a large gas bubble can be seen to rise at a greater rate than a number of small bubbles having the same total volume as the large bubble. Accordingly, it is believed that the mere division of gas in the reservoir into a plurality of discrete volumes increases the buoyancy control of the apparatus.

I claim:

1. In a buoyancy control apparatus for carrying by a diver comprising:

fluid-tight reservoir means;

water inlet valve means for admitting water to said reservoir from externally of the apparatus to displace gas from the reservoir;

gas outlet valve means for releasing said displaced gas from the reservoir to externally of the apparatus;

gas inlet valve means for admitting compressed gas to the reservoir to displace water from the reservoir; and water outlet valve means for releasing said displaced water from the reservoir; whereby water and gas can be selectively admitted to the reservoir to displace gas and water respectively already in the reservoir thereby to change buoyancy of the apparatus, the improvement consisting in that said reservoir is comprised of a plurality of parallel longitudinally extending passageways.

2. The apparatus according to claim 1 wherein the reservoir comprises two or more parallel tubes each comprised of a said plurality of passageways.

3. The apparatus according to claim 2 wherein the tubes are straight.

4. The apparatus according to claim 3 wherein the passageways are twisted en masse about the longitudinal axis of respective tube.

5. The apparatus according to claim 1 wherein the passageways are constituted by bundles of narrow bore thin-walled plastics tubes.

6. The apparatus according to claim 1 comprising a second gas inlet valve means for admitting to the reservoir compressed gas at a higher pressure than that admitted by the first-mentioned valved gas inlet means.

7. The apparatus according to claim 1 wherein the said water inlet and outlet means and gas outlet means connect the reservoir with the ambient environment of the apparatus.

8. The apparatus according to claim 1 wherein the said water inlet means and gas outlet means are controlled by a common mechanism.

9. The apparatus according to claim 8 wherein the said water inlet means and gas outlet means include respective diaphragm valves normally biased to their closed positions and operable against their bias by a compressed gas supply controlled by a common control valve.

10. The apparatus according to claim 1 wherein the said gas inlet means and gas outlet means are provided at one end of each passageway and the said water inlet means and water outlet means are provided at the other end of each respective passageway.

11. The apparatus according to claim 10 wherein the said water inlet means and water outlet means are constituted by a common means.

* * * * *